US005958186A

United States Patent [19]

Holm et al.

[11] Patent Number: 5,958,186

[45] Date of Patent: Sep. 28, 1999

[54] NONWOVEN MATERIAL CONTAINING A MIXTURE OF PULP FIBRES AND LONG HYDROPHILLIC PLANT FIBRES AND A METHOD OF PRODUCING THE NONWOVEN MATERIAL

[75] Inventors: Ulf Holm, Göteborg; Ebbe Milding, Mölnlycke, both of Sweden

[73] Assignee: SCA Hygiene Products Aktiebolag, Goteborg, Sweden

[21] Appl. No.: 08/809,234

[22] PCT Filed: Oct. 20, 1995

[86] PCT No.: PCT/SE95/01236

§ 371 Date: Mar. 19, 1997

§ 102(e) Date: Mar. 19, 1997

[87] PCT Pub. No.: WO96/12849

PCT Pub. Date: May 2, 1996

[30] Foreign Application Priority Data

Oct. 24, 1994 [SE] Sweden ..... 9403618

[51] Int. Cl.[6] ..... D21F 11/00

[52] U.S. Cl. ..... 162/115; 162/201; 162/108; 162/91; 162/95; 162/96; 162/97; 162/98; 162/99; 162/147; 162/148; 28/104; 28/105; 28/107; 428/311.51; 442/408; 442/402

[58] Field of Search ..... 162/108, 115, 162/201, 101, 91, 95, 96, 97, 98, 99, 148, 149; 28/104, 105, 107; 442/408, 402; 428/311.11, 311.51, 311.71

[56] References Cited

U.S. PATENT DOCUMENTS

| | | | |
|---|---|---|---|
| 4,939,016 | 7/1990 | Radwanski et al. | 428/152 |
| 5,009,747 | 4/1991 | Viazmensky et al. | 162/115 |
| 5,106,457 | 4/1992 | Manning | 162/115 |
| 5,137,600 | 8/1992 | Barnes et al. | 162/115 |

FOREIGN PATENT DOCUMENTS

| | | |
|---|---|---|
| 841 938 | 5/1970 | Canada . |
| 0 483 816 A1 | 5/1992 | European Pat. Off. . |
| WO 91/08333 | 6/1991 | WIPO . |

*Primary Examiner*—Stanley S. Silverman
*Assistant Examiner*—José A. Fortuna
*Attorney, Agent, or Firm*—Burns, Doane, Swecker & Mathis LLP

[57] ABSTRACT

Nonwoven material produced by hydroentanglement of a wet-laid or foam-formed fibre web. The material comprises a mixture of short plant fibres, in particular pulp fibres, and long hydrophillic plant fibres, where the major portion of the fibres presents a fibre length which is at least 10 mm, whereby the portion of long fibres is at least 1 weight-% of the fibre weight. The fibres were mixed with each other in the presence of a dispersing agent which allows a uniform fibre formation, in a wet-laid or foam-formed fibre web which has been hydroentangled with sufficient energy to form a compact absorbing material.

11 Claims, No Drawings

NONWOVEN MATERIAL CONTAINING A MIXTURE OF PULP FIBRES AND LONG HYDROPHILLIC PLANT FIBRES AND A METHOD OF PRODUCING THE NONWOVEN MATERIAL

This application is a 371 of PCT/SE95/00236, filed on Oct. 20, 1995.

BACKGROUND TO THE INVENTION

The present invention relates to a nonwoven material produced by hydroentanglement of a wet-laid or foam-formed fibre web.

Hydroentanglement or spunlacing is a technique which was introduced in the 1970's, see e.g. CA patent no. 841, 938. The method involves forming a fibre web, either wet-laid or dry-laid, whereafter the fibres are entangled, i.e. tangled together by means of very fine water jets under high pressure. A plurality of rows of waterjets are directed towards the fibre web which is supported by a moving wire (mesh). The entangled web is then dried. The fibres which are used in the material can be constituted by synthetic or regenerated staple fibres, e.g. polyester, polyamide, polypropylene, rayon or the like, by pulp fibres or by mixtures of pulp fibres and staple fibres. Spunlace materials can be produced with high quality at a reasonable cost and they present good absorption characteristics. They are used, inter alia, as wipes or cleaning cloths for household or industrial use, as disposable materials for health care, etc.

EP-A-0 483 816 describes the production of a wet-laid hydroentangled material based on 100% pulp fibres. A hydroentangled nonwoven material consisting of 100% pulp fibres may have insufficient strength properties for certain applications of use where the material is subjected to high loading in a wet condition.

In order to achieve high material strength, a mixing-in of fibres which are longer than the pulp fibres is required. It is therefore common, as mentioned above, to mix in a certain proportion of synthetic or regenerated staple fibres. The synthetic fibres which are used are produced essentially from raw materials originating from oil or natural gas. The combustion or the biological breaking-down of the nonwoven waste based on synthetic fibres contributes to the so-called "greenhouse effect" since the fossil-bound carbon is released in the form of carbon dioxide. From this aspect it would be an advantage to make use of plant fibres instead of synthetic fibres for nonwoven production since no fossil carbon is released upon combustion or biologically breaking-down the material containing plant fibres and/or pulp fibres.

Wet-laying of long hydrophillic cellulosic fibres is difficult since the low wet bending stiffness of the fibres and their flocking tendency give rise to materials with non-uniform fibre formation. The problem with non-uniform fibre formation is additionally increased if hydroentanglement is used as a binding method.

According to WO 91/08333, hydrophobic plant fibres can be wet-laid and bound by means of hydroentanglement, resulting in a hydrophillic nonwoven material. In this case the hydrophobic fibres maintain a large part of their bending stiffness during the wet-laying process, which allows a comparatively uniform fibre formation.

OBJECT OF THE INVENTION AND THE MOST IMPORTANT FEATURES

The object of the present invention is to achieve a hydroentangled nonwoven material based on natural fibres, which material presents good absorption characteristics and high quality otherwise. This has been solved according to the invention by the material containing a mixture of short plant fibres, in particular pulp fibres, and long hydrophillic plant fibres, where the main component of the fibres presents a fibre length of at least 10 mm, whereby the proportion of long plant fibres is at least 1 weight-%, and in that the fibres are mixed with each other in the presence of a dispersing agent which allows a uniform fibre formation, in a wet-laid or foam-formed fibre web which has been hydroentangled with sufficient energy to form a compact absorbing material.

The invention further relates to a method of producing the nonwoven material in question.

DESCRIPTION OF THE INVENTION

The fibre raw material for the nonwoven material is constituted in part by short plant fibres, in particular pulp fibres, but also by fibres from esparto grass, reed canary grass and straw etc., where the major part of the fibres in question, i.e. more than 50 weight-%, have a fibre length which is less than 5 mm, and in part by long hydrophillic plant fibres where the major part of the fibres presents a fibre length of at least 10 mm. The long plant fibres may be constituted by all types of leaf fibres, bast fibres and seed hair fibres which are hydrophillic and where the major part of the fibres, i.e. more than 50 weight-%, are 10 mm long or longer.

Examples of leaf fibres are abaca, pineapple and phormium tenax; examples of bast fibres are flax, hemp and ramie and examples of seed hair fibres are cotton, kapok and milkweed. The long plant fibres are preferably constituted by elementary fibres, i.e. detached (freed) separate fibres. Seed hair fibres are present naturally in the form of elementary fibres, whilst leaf and bast fibres first have to be freed in order for the elementary fibres to be obtained.

The invention implies that a fibre web comprising a mixture of pulp fibres and long hydrophillic plant fibres is wet-laid or foam-formed in the presence of a dispersion agent. The dispersion agent can either be directly added to the long plant fibres in the form of a so-called "fiber finish" or it can be added to the water system in a wet-laying or foam-forming process. The addition of a suitable dispersion agent allows a good formation of the otherwise very difficult-to-form long hydrophillic plant fibres. Without the addition of a suitable dispersing agent, the fibre formation becomes far too non-uniform for a good entanglement result to be obtained. The dispersion agent can be of many different types which give the right dispersion effect on the pulp/plant fibre mixture which is used. An example of a dispersion agent which works well for a plurality of plant fibres, e.g. flax and ramie, is a mixture of 75% bis (hydrogeneratedtallowalkyl)dimethyl ammonium chloride and 25% propyleneglycol. The addition ought to be within the range of 0.01–0.1 weight-%.

During foam-forming the fibres are dispersed in a foamed liquid containing a foam-forming surfactant and water, whereafter the fibre dispersion is dewatered on a wire (mesh) in the same way as with wet-laying.

The thus-formed fibre web is subjected to hydroentanglement with an energy input which preferably lies in the range 200–800 kWh/ton. The hydroentanglement is carried out using conventional techniques and with equipment supplied by machine manufacturers.

After hydroentanglement, the material is pressed and dried and wound onto a roll. The ready material is then converted in a known way to a suitable format and is packed.

Material which is produced according to the invention has sufficiently good strength characteristics to be able to be used as a wiping material even in applications where relatively high strengths in the wet state are required. The properties of the material can be additionally improved by the addition of a suitable binder or wet-strength agent via impregnation, spraying, coating or by using another suitable application method. The material is primarily intended as a wiping material for household use or for large users like workshops, industry, hospitals or other public institutions.

EXAMPLE

Several different materials with varying fibre compositions were produced and tested, whereby a comparison was made with a commercial wiping cloth made in a corresponding manner. The pulp fibres were constituted in all cases by bleached chemical softwood pulp. The synthetic fibres were constituted by polyester and polypropylene 1.7 dtex×12 mm respectively. The plant fibres which were used were ramie fibres which, after being freed, were cut to a 12 mm maximum length. In this case a cationic surfactant was also used as the dispersion agent during forming. Fibre webs were produced by wet-laying and these were then hydroentangled with an energy input which varied between 265 to 600 kWh/ton, lightly pressed and dried by means of through-air drying. The properties of the materials are presented in table 1.

The results show that the material according to the invention which contained 50% ramie fibres, instead of 50% synthetic fibres, gave lower strengths in the dry state but similar or, in certain cases, higher wet strengths than the synthetic fibre materials. From this it is clear that it is fully possible to produce a high quality wet-laid spunlace material based totally on natural fibres.

TABLE 1

| | Commercial drying cloth | Test material #1 | Test material #2 | Material according to the invention |
|---|---|---|---|---|
| Forming technique | wet-laid | wet-laid | wet-laid | wet-laid |
| Dispersion agent | | | | cationic surfactant |
| % Pulp fibres | 60 | 50 | 50 | 50 |
| % Polyester 1.7dtex · 12 mm | 22 | 50 | — | — |
| % Polypropylene 1.7dtex · 12 mm | 18 | — | 50 | — |
| % Ramie 12 mm (plantfibres) | — | — | — | 50 |
| Entanglement energy, KWh/ton | 600 | 554 | 590 | 265 |
| Pressing | light | light | light | light |
| Drying | through-air 130° C. | through-air 130° C. | through-air 130° C. | through-air 130° C. |
| Basis weight, g/m$^2$ | 80 | 93, 2 | 87, 5 | 94, 3 |
| Thickness, $\mu$m | 420 | 444 | 532 | 395 |
| Dry tensile strength MD, N/m | 1400 | 4001 | 1838 | 1158 |
| Dry tensile strength CD, N/m | 650 | 1665 | 1194 | 469 |
| Elongation MD, % | 30 | 44 | 72 | 27 |
| Elongation CD, % | 60 | 76 | 115 | 57 |
| Wet tensile strength MD, N/m | 660 | 580 | 680 | 790 |

TABLE 1-continued

| | Commercial drying cloth | Test material #1 | Test material #2 | Material according to the invention |
|---|---|---|---|---|
| Wet tensile strength CD, N/m | 320 | 191 | 249 | 286 |

1) dispersion agent of commercially available type
2) bleached chemical softwood pulp
3) commercially available polyester fibres for wet-laid nonwoven
4) commercially available polypropylene fibres for wet-laid nonwoven
5) ramic fibres which were cut after freeing to a max. length of 12 mm.

We claim:

1. Nonwoven material produced by hydroentanglement of a wet-laid or foam-formed fibre web, comprising:

a mixture of short plant fibres, where a major portion of the short plant fibres presents a fibre length below 5 mm, and long hydrophillic plant fibres in the form of elementary fibres where a major portion of the long hydrophillic plant fibres presents a fibre length which is at least 10 mm, wherein the long hydrophillic plant fibres is at least 1% weight of the fibre weight, the fibres of said nonwoven material comprise only natural fibres, and the short plant fibres and the long hydrophillic plant fibres have been mixed with each other in the presence of a dispersing agent which allows a uniform fibre formation, in a wet-laid or foam-formed fibre web which has been hydroentangled with sufficient energy to form a compact adsorbing material.

2. Nonwoven material according to claim 1, wherein the long hydrophillic plant fibres are constituted by leaf fibres including abaca, pineapple, phormium tenax; bast fibres including flax, hemp, ramie; or seed hair fibres including cotton, kapok or milkweed.

3. Nonwoven material according to claim 1, wherein the proportion of long hydrophillic plant fibres is between 5 and 80 weight-%.

4. Nonwoven material according to claim 3, wherein the proportion of long hydrophillic plant fibres is between 20 and 60 weight-%.

5. Nonwoven material according to claim 1, wherein the nonwoven material includes a wet strength agent or a binder.

6. Nonwoven material according to claim 1, wherein the nonwoven material has a wet strength MD greater than 680 N/m and a wet strength CD greater than 240 N/m.

7. Nonwoven material according to claim 1, wherein the nonwoven material has a wet strength MD of about 790 N/m, or greater, and a wet strength CD of about 286 N/m, or greater.

8. Non-woven material according to claim 1, further comprising a wet strength agent between 0.1 and 10% weight.

9. Nonwoven material according to claim 8, wherein the proportion of wet strength agent or chemical is between 1 and 5 weight-%.

10. Method of producing a nonwoven material according to claim 1, wherein a fibre web is formed by wet-laying or foam-forming, said fibre web comprising between 1 and 99 weight-% of pulp fibres or alternatively other plant fibres, calculated with respect to the total fibre weight, where the major part of the fibres has a fibre length below 5 mm, as well as between 1 and 99 weight-% long hydrophillic plant fibres calculated with respect to the total fibre weight, where the major part of the fibres presents a fibre length of at least 10 mm, in the presence of a dispersion agent which allows a uniform fibre formation, and by forming a compact absorbent material of entangled fibres by subjecting the fibre web to hydroentanglement and thereafter drying the material.

11. Method according to claim 10, wherein in connection with the hydroentanglement a wet strength agent or binder is added to the material by spraying, impregnation, or coating.

* * * * *